US011248186B2

(12) United States Patent
Pierce

(10) Patent No.: US 11,248,186 B2
(45) Date of Patent: Feb. 15, 2022

(54) FIRE STARTER SYSTEM, METHOD OF USE, AND METHOD OF MANUFACTURE

(71) Applicant: Thomas R. Pierce, Olathe, KS (US)

(72) Inventor: Thomas R. Pierce, Olathe, KS (US)

( * ) Notice: Subject to any disclaimer, the term of this patent is extended or adjusted under 35 U.S.C. 154(b) by 0 days.

(21) Appl. No.: 16/870,177

(22) Filed: May 8, 2020

(65) Prior Publication Data

US 2020/0354643 A1 Nov. 12, 2020

Related U.S. Application Data

(60) Provisional application No. 62/845,121, filed on May 8, 2019.

(51) Int. Cl.
*C10L 11/04* (2006.01)
*C10L 11/06* (2006.01)

(52) U.S. Cl.
CPC ..... *C10L 11/04* (2013.01); *C10L 11/06* (2013.01); *C10L 2200/0469* (2013.01); *C10L 2230/06* (2013.01)

(58) Field of Classification Search
CPC .. C10L 11/04; C10L 11/06; C10L 2200/0469; C10L 2230/06; C10L 2230/10; C10L 2230/18
See application file for complete search history.

(56) References Cited

U.S. PATENT DOCUMENTS

2002/0129808 A1* 9/2002 Manner ..... C10L 5/40 126/45
2006/0117649 A1* 6/2006 Schweickhardt ..... C10L 5/368 44/535
2011/0274859 A1* 11/2011 Hauser ..... B32B 1/08 428/34.2
2018/0312774 A1* 11/2018 Ream ..... C06F 5/00
2021/0033278 A1* 2/2021 Decker ..... C11C 5/004

* cited by examiner

*Primary Examiner* — Ellen M McAvoy
*Assistant Examiner* — Chantel L Graham
(74) *Attorney, Agent, or Firm* — Law Office of Mark Brown, LLC; Christopher M. DeBacker

(57) ABSTRACT

A fire starter device with a cloth or paper substrate, such as a herringbone cloth material, which is coated in a micro crystalline wax. Paraffin wax may also be added to the mixture in a small amount. The device is cut into strips which can be rolled or otherwise positioned to create a fire starter. The ends of the substrate may be left uncoated to promote lighting the ends with a fire source. An auto-starter element can be built into the fire starter near one of the ends. The substrate may be died or printed with a logo or other elements. The wax may be scented.

25 Claims, 10 Drawing Sheets

FIRE STARTER SYSTEM, METHOD OF USE, AND METHOD OF MANUFACTURE

CROSS-REFERENCE TO RELATED APPLICATION

This application claims priority in U.S. Provisional Patent Application No. 62/845,121 Filed May 8, 2019, which is incorporated herein by reference.

BACKGROUND OF THE INVENTION

1. Field of the Invention

The present invention relates generally to a fire starter system and method for use thereof, and more specifically to a wax and cloth fire starter system for use in remote locations, outdoors, and in loss of power situations.

2. Description of the Related Art

Typical products used for outdoor fire starting require additional fuel for prolonged burning, and are not designed to provide a self-contained fire source capable of boiling water or otherwise providing a cooking source of heat.

Heretofore there has not been available a system or method for a fires starter system with the advantages and features of the present invention.

BRIEF SUMMARY OF THE INVENTION

The present invention generally provides a cloth or paper substrate, such as a herringbone cloth material, which is then coated in a micro crystalline wax. Paraffin wax may also be added to the mixture in a small amount.

In a preferred embodiment the cloth substrate is cut into a rectangular piece before the coating is applied. A typical piece may be 12.5"×22" or similar dimensions. One end of the substrate may remain uncoated by the wax and allows for easy lighting of the fire starter; however, the entire substrate could be coated in some embodiments.

After coating the substrate in wax, this typical piece can be cut into smaller strips, such as 2", 3", or 4" wide strips, for different burn purposes.

Once cut the strip can be rolled into a cylinder approximately the size of a quarter with the uncoated end located on the inside of the roll. The rolls should be rolled tight. The uncoated portion can be lit which will spread to the rest of the rolled strip, providing a flame suitable for boiling water or food preparation. A looser roll will reduce burning time with a benefit of a more intense flame.

When folded up with the uncoated end placed within the center of the fold, the product is effectively waterproof due to the wax coating.

An accelerant may also be applied to the uncoated end or under the coating near the uncoated end.

A logo or color can be added to the cloth or paper substrate strip and color can also be added to the wax coating.

Scents may be integrated with the wax and cloth substrate.

An embodiment of the present invention may include an auto-light element which allows the product to be ignited without the use of external igniters. A pull string, stick, zipper-element, or other element which provides a push, pull, tear, or tear-away element from the strip to produce a spark or cause ignition of the strip may be used.

An embodiment of the present invention will be designed to allow increased air flow into the product during the burning process. This could include adding slits or holes into the strips to increase airflow through the device. Additional air flow will increase fire temperature throughout the burn process.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Fire Starter System 2

Figure 1:
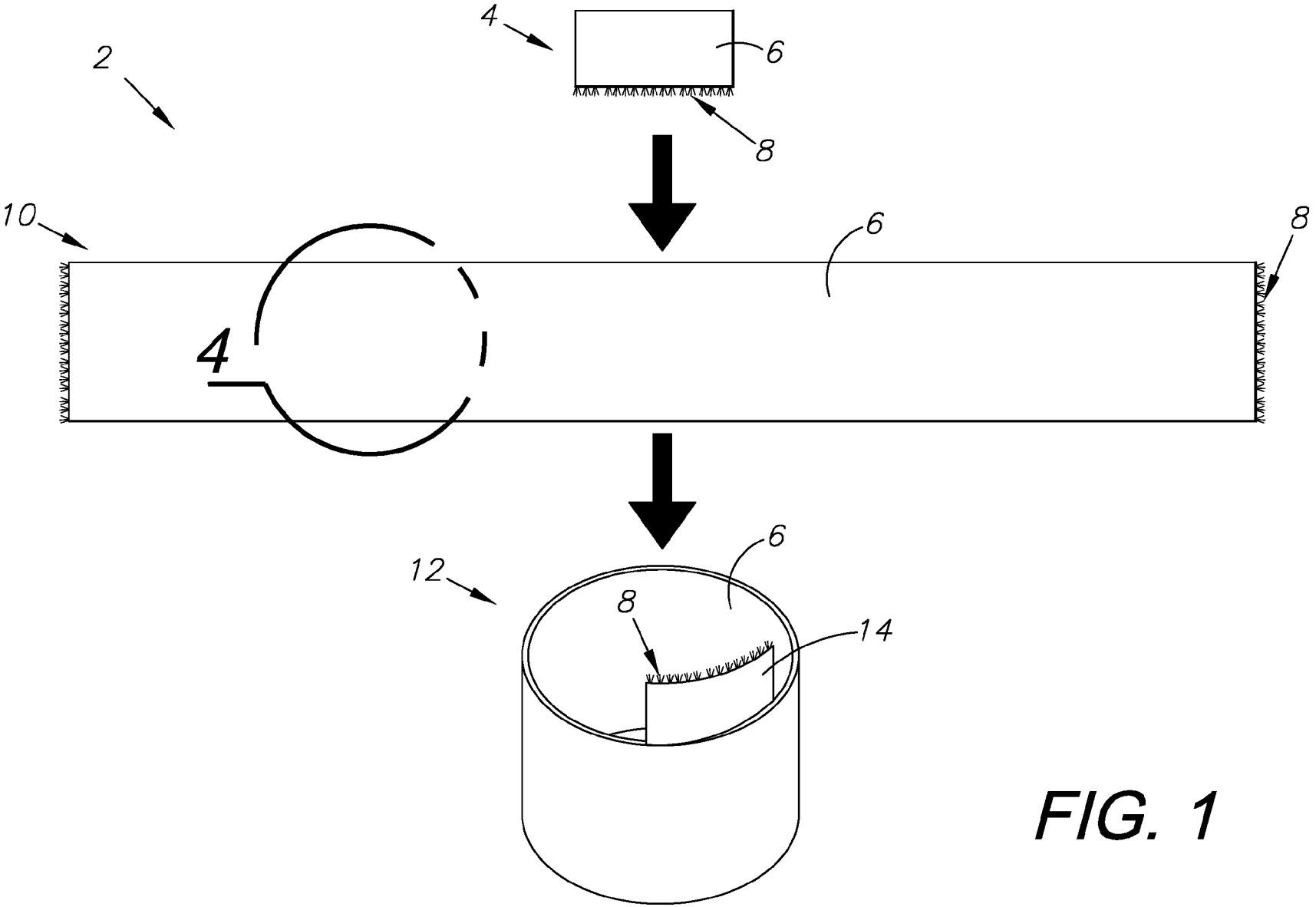
FIG. 1 is a diagrammatic representation of a preferred embodiment of the present invention as it is transformed from a first, folded orientation to a second, unfolded orientation, and to a final, assembled, unlit orientation.

As shown in FIGS. 1-5, the present invention is a strip of cloth or paper substrate 6 which is coated in a micro crystalline wax 22. Preferred wax types would be CW-175 Micro A or CW-155 Pet A micro crystalline wax sold by Calumet Specialty Products Partners, LP of Indianapolis, Ind. Paraffin wax may also be included in the mixture up to 25%. At least one end 8 of the substrate may be left uncoated to act as a lighting surface, such as shown in FIG. 1. Alternatively, the uncoated end 8 could include an accelerant for easier lightning.

Figure 2:
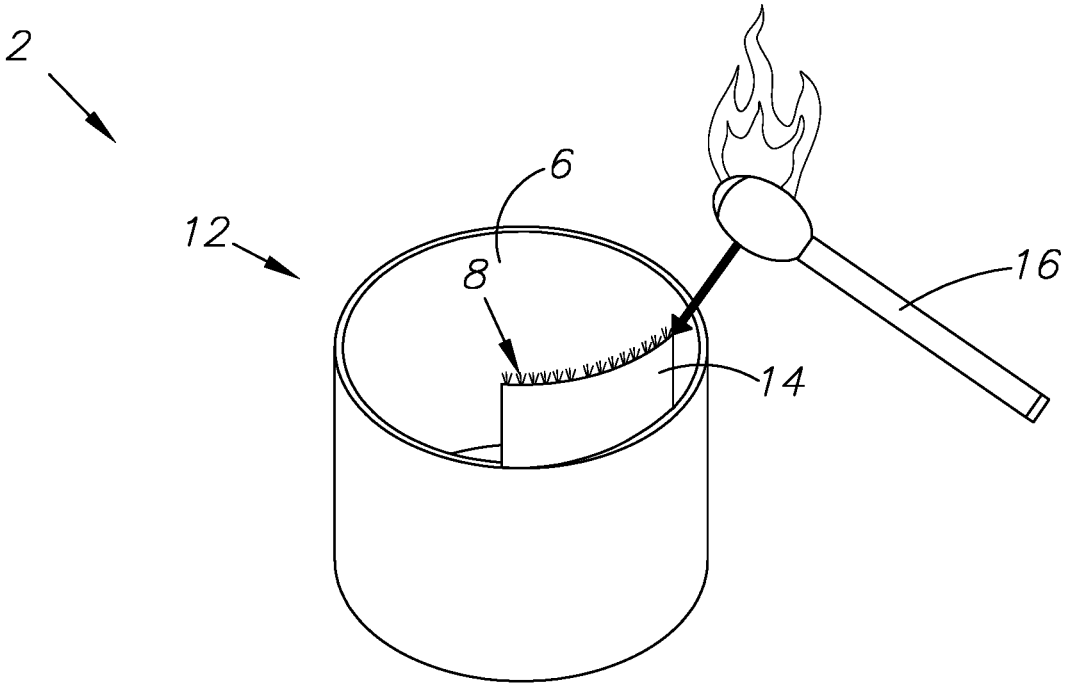
FIG. 2 is a three-dimensional isometric view of a loosely rolled cylindrical embodiment thereof shown in conjunction with a fire source.
Figure 3:
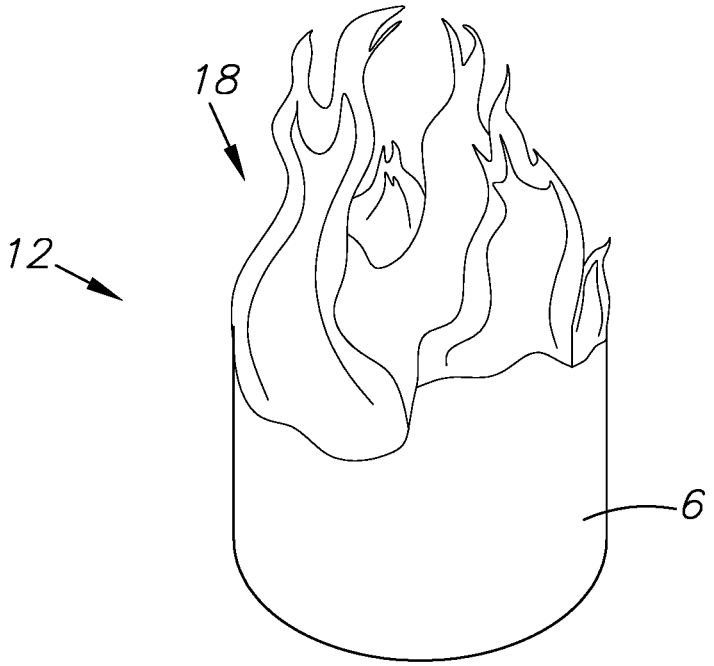
FIG. 3 is a three-dimensional isometric view thereof, shown with the loosely rolled cylindrical embodiment thereof in a lit orientation.

FIG. 1 shows how the fire starter system 2 begins in a folded, stored orientation 4, and can be unfolded into a flat orientation 10, which is then rolled up into an assembled and deployed orientation 12 where it can be used to start a fire. A wick portion 14 which includes an uncoated end 8 can be pulled up and used to light the fire starter 2 with a match 16 or other fire source as shown in FIG. 2. FIG. 3 shows how the flame 18 would engulf the upper portion of the fire starter system 2 and slowly work its way downward, slowed and enhanced by the wax.

The fire starter system 2 could either be sold in pre-cut strips, or provided in larger strips which can be cut to size by the user. Larger strips provide for longer burning. The strips can be rolled into the deployed orientation as shown in FIGS. 2 and 3 to provide directed heat for boiling water or other food preparation purposes. Longer strip and looser rolls provide for reduced burning time but will burn with more intensity. The strips 6 can also simply be lit without being rolled into the deployed orientation.

Figure 4:
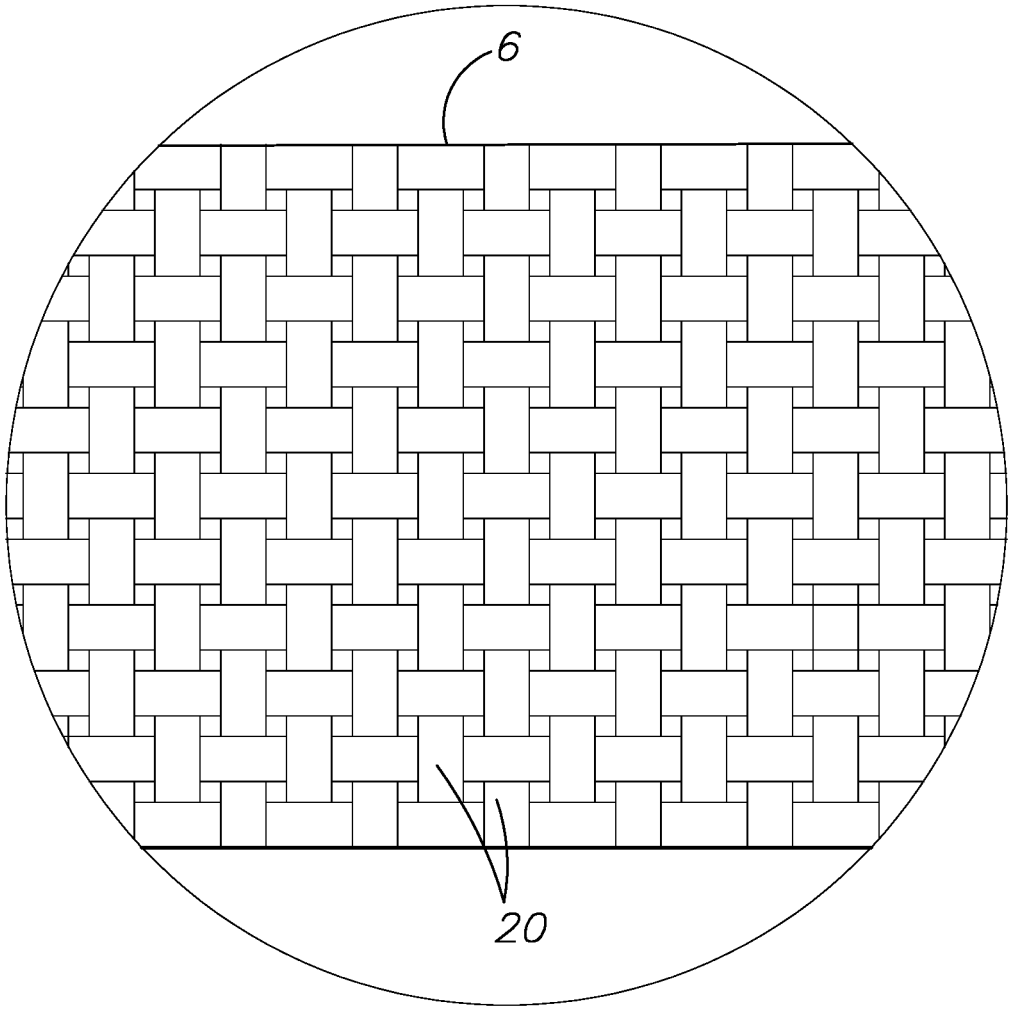
FIG. 4 is a detailed view taken about the circle of FIG. 1 showing a woven fabric substrate.
Figure 5:
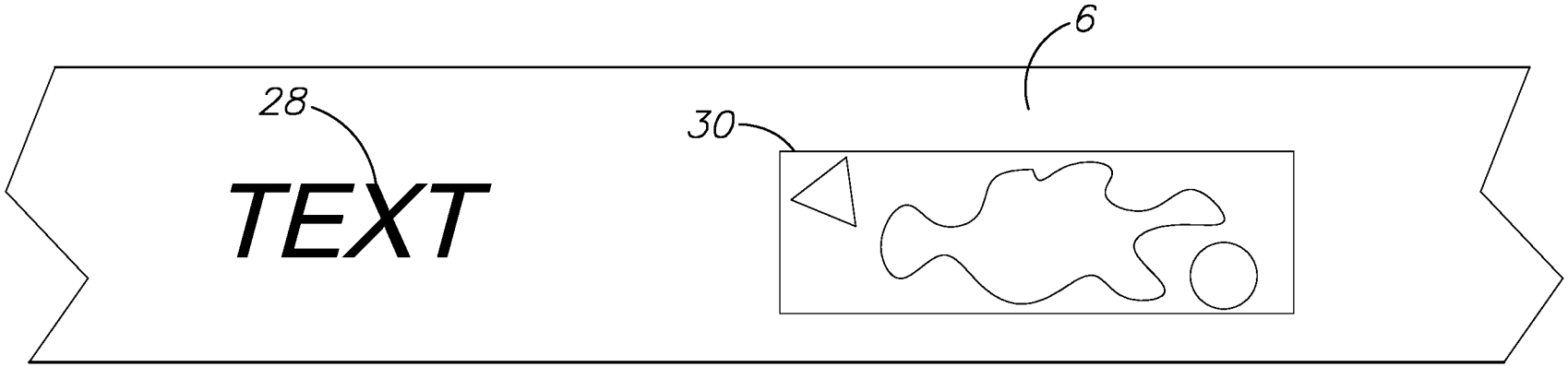
FIG. 5 is a top plan view of a substrate element thereof showing optional features.
Figure 6:
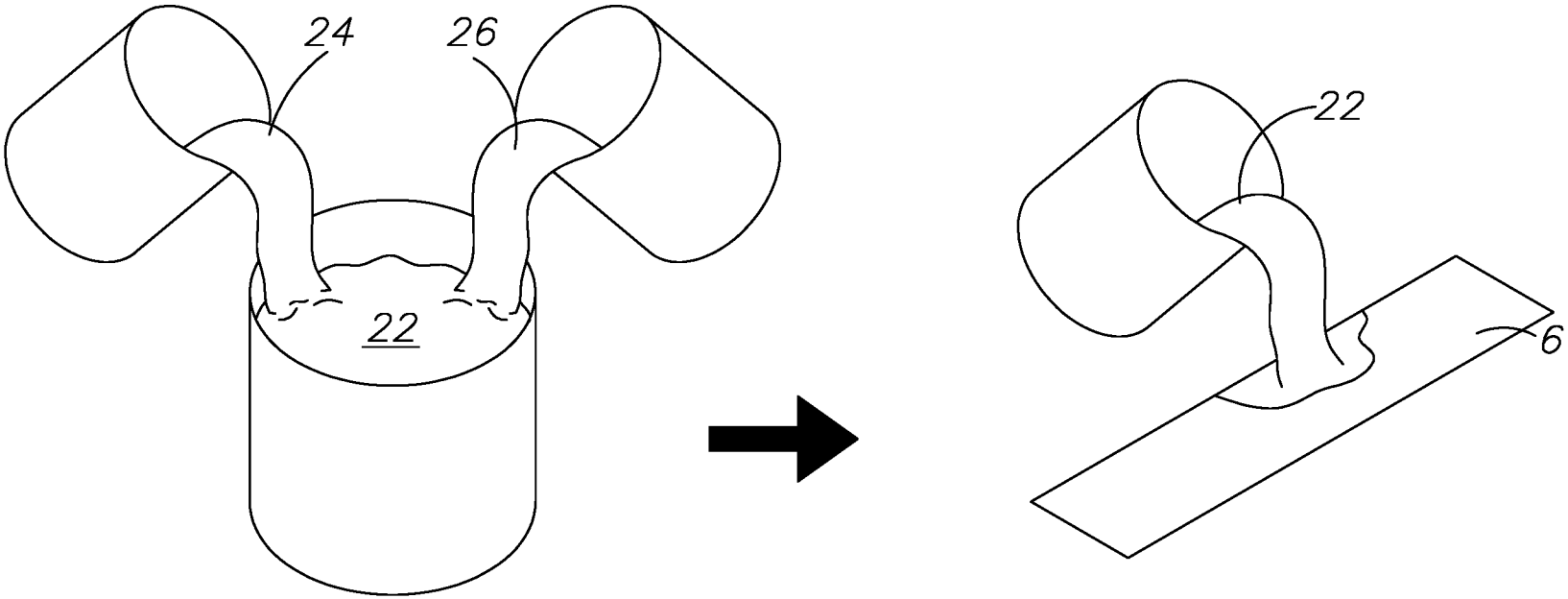
FIG. 6 is a three-dimensional diagram showing a process of preparing a coating element thereof.

As manufactured, the micro crystalline wax 22 renders the substrate waterproof and should have no limited shelf life for use. FIG. 4 shows how the strip 6 itself may be made of a fabric or paper weave 20, however if paper is used as the strip 6 substrate, a weave is not necessary. FIG. 5 shows how text 28 or images 30, such as a logo, may be printed to the substrate strip 6. FIG. 6 shows a representation of the micro crystalline wax 22 which may optionally have a scent 24 or color 26 added to it. As stated above, paraffin wax may also be added in a small amount. Once finalized, the microcrystalline wax 22 is applied to the strip 6.

Other elements may be added to the substrate and/or the wax. For example, the substrate could also be permeated with a scent. Another example includes either the substrate or the wax or both to contain minerals or other color change materials which would alter the color of the flame put out by the fire starter when lit. Other combinations include a chemical compound acting as an insect repellent, such as Citronella oil. An antiseptic and/or antibiotic chemical could also be added so that the strip could be used as a first aid bandage.

III. Alternative Embodiment Fire Starter System 52

Figure 7:
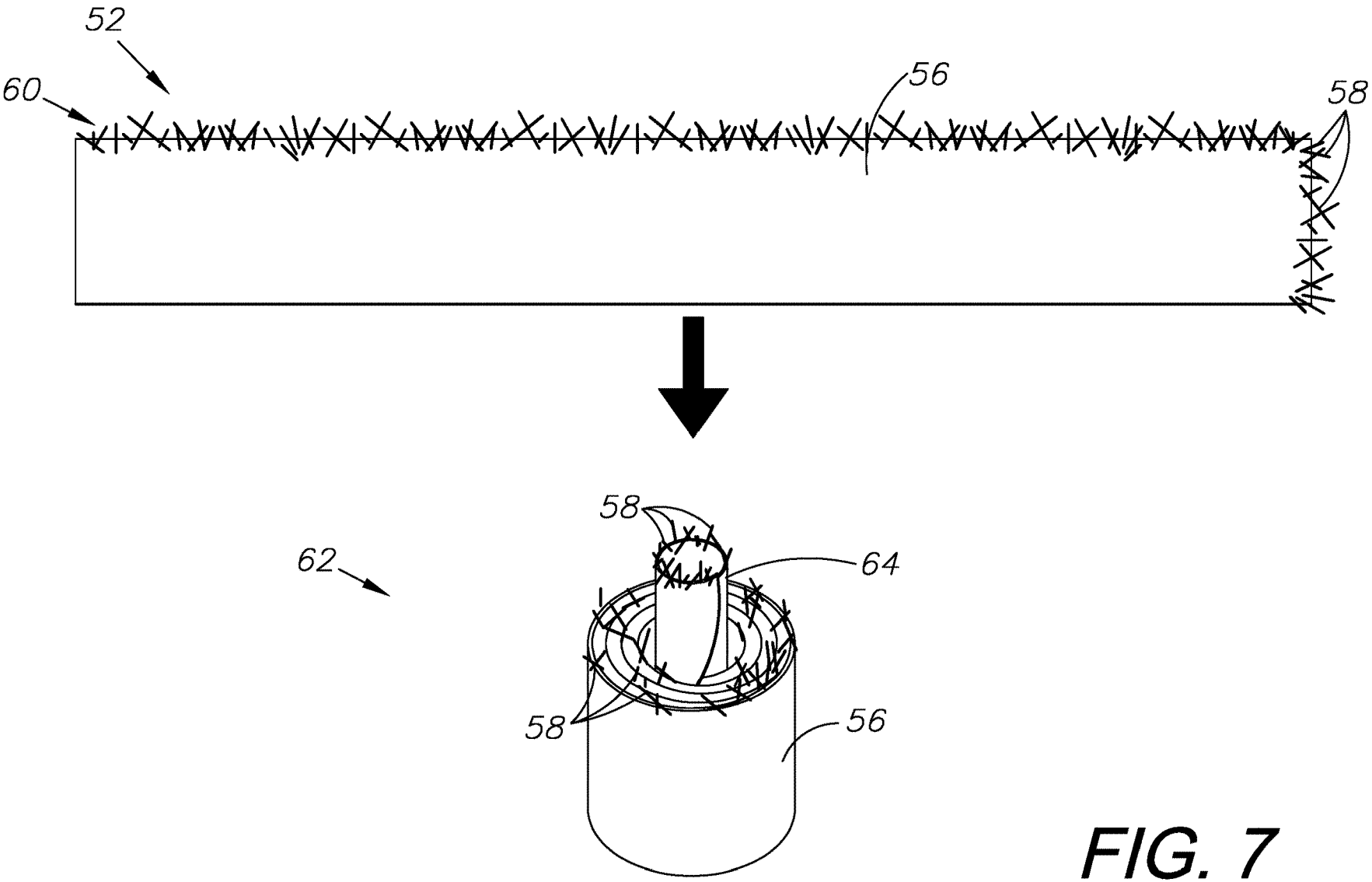
FIG. 7 is a diagrammatic representation of an alternative embodiment of the present invention including wood shavings on ends thereof and shown in an unfolded orientation and an assembled, unlit, tightly rolled cylindrical orientation.

FIG. 7 shows an alternative embodiment fire starter system 52 in a first, unrolled orientation 60 and a second, rolled and deployed orientation 62. Each are shown with wood shavings 58 glued or otherwise affixed to ends and sides of the strip 56. The wood shavings may be held in place by the wax over the substrate strip 56. Again, the deployed orientation 62 may include a pulled up portion 64 of the strip 56 which serves as a wick. The wood shavings 58 are easier to light and serve as an accelerant.

IV. Alternative Embodiment Auto-Light Fire Starter System 102

Figure 8A:
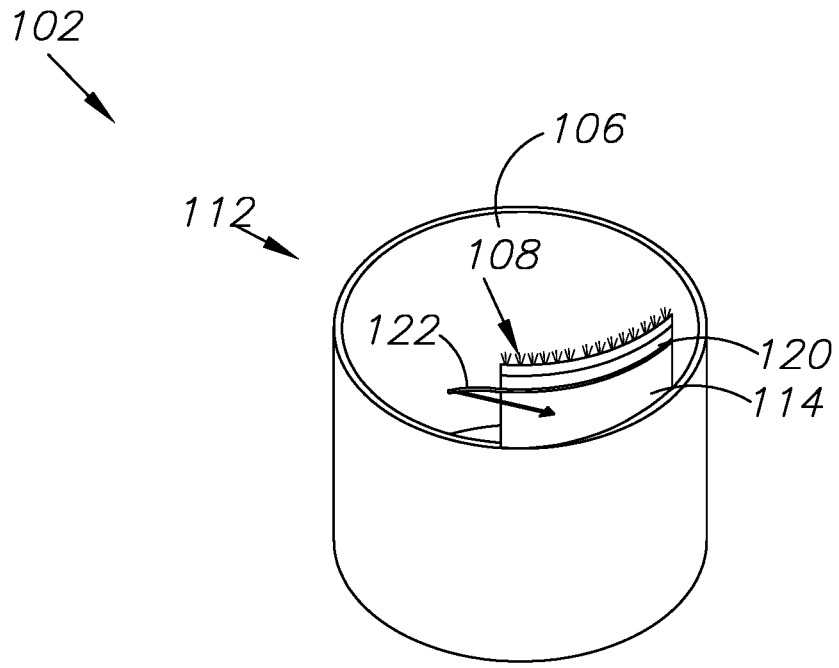
FIG. 8A is a three-dimensional isometric view of yet another embodiment of the present invention including an auto-start element.
Figure 8B:
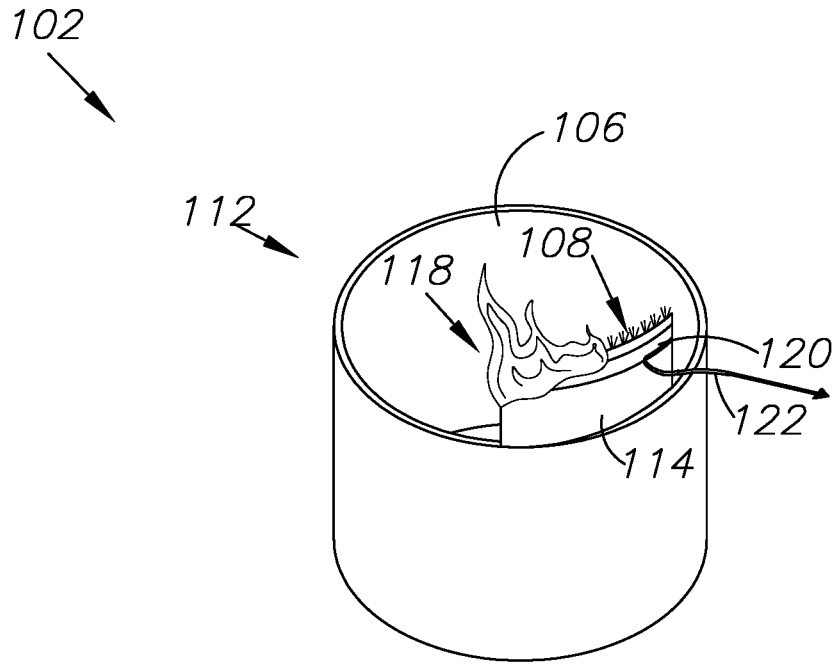
FIG. 8B is a three-dimensional isometric view thereof, showing the auto-start element in use.
Figure 9A:
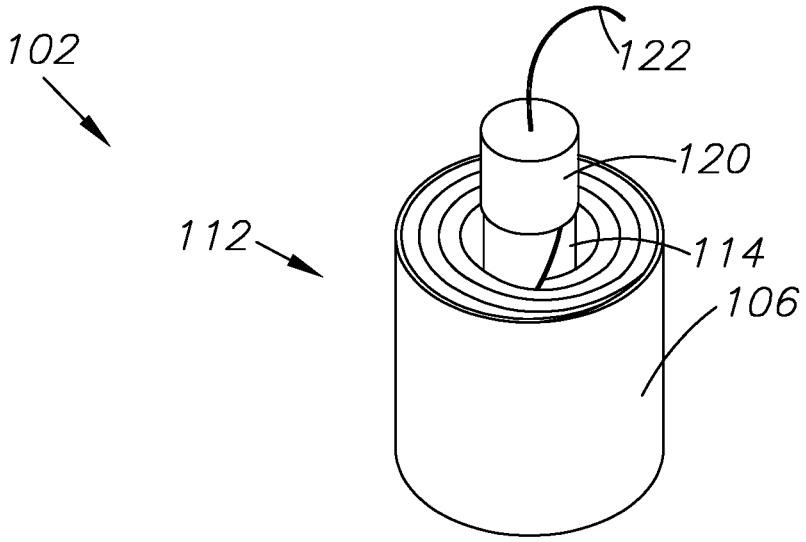
FIG. 9A is another three-dimensional isometric view thereof shown in a slightly alternative orientation.
Figure 9B:
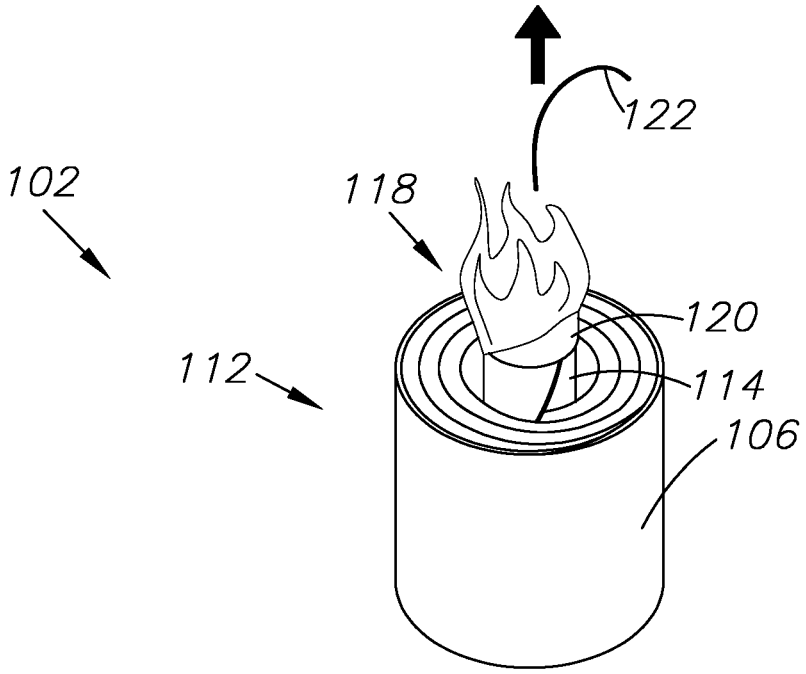
FIG. 9B is a three-dimensional isometric view thereof, showing the auto-start element in use.

FIGS. 8A and 8B show an alternative embodiment auto-light fire starter system 102. Either of the previous embodiments 2, 52 may be used in conjunction with the auto-light function. One example of an auto-light function is shown in the form of a passive portion, such as a strip 120, with an active portion, such as a pull string 122 located near an uncoated end 108 of the coated substrate 106, which is used as the pulled up portion 114 serving as a wick in the deployed orientation 112. As shown in FIG. 7, when the pull string 122 is pulled, it causes sparks and flames 118 from the strip 120, thereby lighting the fire starter system 102. Other auto-start features can be used instead of the pull string, such as a stick, zipper-element, or other element which provides a push, pull, tear, or tear-away element from the strip to produce a spark or cause ignition of the strip 120. FIGS. 9A and 9B show a more tightly rolled version thereof, with a slightly modified auto starter strip 120 and pull string 122 elements.

V. Method of Manufacture of a Fire Starter System 202

The process in manufacturing varies; there are multiple ways for the fire starter to be manufactured. One process would be to have materials cut into medium sized rectangles approx. 12.5"×22", then micro crystalline wax will be heated in a container like a large cooking pot, once the wax is heated to 200° F. the rectangular cloth substrate will be lowered into the hot wax and pulled out once the materials are coated to within 1 inch from the end of the substrate. The materials will need to be held over the container with the wax until the dripping stops. The coated materials can then be hung up on a line to complete the cooling process. Once cooled and coating work is complete, the rectangles can be measured and cut into smaller strips and ready for use.

The second way this can be manufactured is for the materials to be precut in the same way as the process above, the difference will be that the coating and cooling process will be automated in a way suitable to speed the process for manufacturing. This will require equipment not yet designed and fabricated. The machine to do this will need to be fabricated with 4 sides, it will be a frame work approximately 5' tall and each side being 5' wide made of angle iron or similar metal. There would be a chain drive that goes around the top of the frame work, driven by a stepper motor with drive or a gear motor with required ratio and horsepower to drive the chain work. At each cycle the chain work would travel exactly 5' per cycle and would allow 4 to 5 rectangles of materials be attached at the loading side of the equipment.

When cycled the chain would rotate the rectangles around to the coating side and then a tank of hot wax would raise up to the rectangles coating them as it came up. The tank would be driven by a pair of linear actuators that would stop at a programmed height just approximately 1" below the edge of the materials being coated. The tank would come back down at the preprogrammed time and speed and once down the rectangles will drip dry or until no more wax is dropping off, this will be a preset timer as well to accommodate different dry times and process needs. The chain would then move again to the next station where the coating would cool down for handling, in this area there would be cooling fans and other required cooling means depending on the ambient conditions of the processing area. In the meantime, once the cycle is initiated there will be other rectangles being loaded onto the chain on the loading side as well as another set being coated on the coating side. Once the timing cycle is completed the machine will move the cooled product to the unloading station, this station could be used as a secondary cooling stage or if completely cooled can be used as an unloading area and for packaging as well. If this side is used as a secondary cooling stage then the loading station would be used as an unloading station as well. The cycle would repeat as long as production is needed for the product. The machine would run at a 3-minute cycle.

The third way this production could be accomplished is to feed the substrate through a slitter to cut the materials into set widths from a roll of materials into a roller bath with a tank of hot crystalline wax, after this it would go through a cooling area, after coating and cooling the machine would feed the strips into a cutting device which would cut them into lengths preprogrammed and then feed out onto a packaging table. In the process the printing and fragrance could be incorporated into the process.

The printing would be done in 2 or 3 different ways, 2 of the ways would be for the cloth or paper materials to be direct printed roll to roll on a large format printer, Sublimated from printed paper onto the cloth through the process of heating the paper against the cloth to transfer the image, or to screen print the image onto the substrate.

Figure 10:
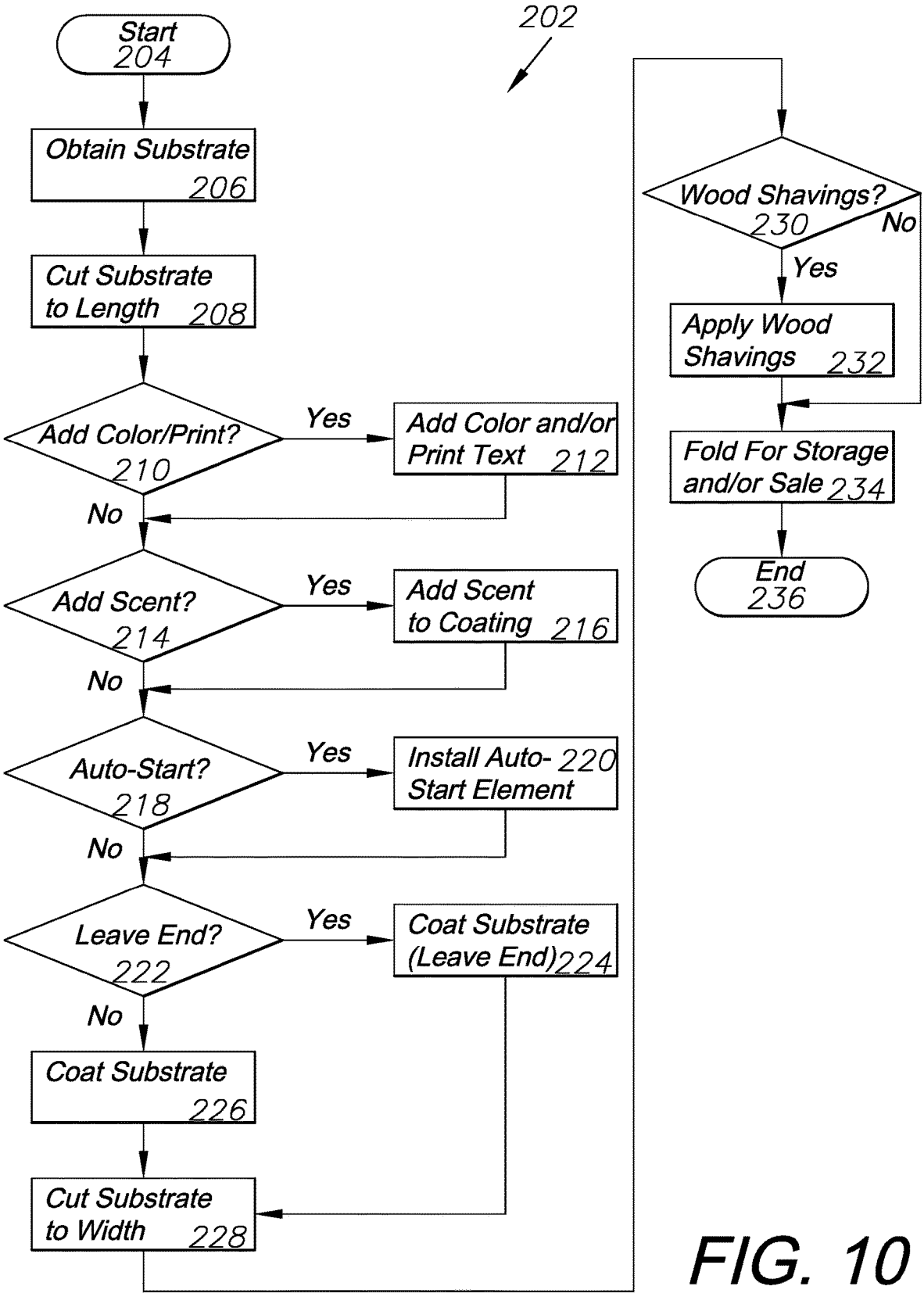
FIG. 10 is a flowchart diagramming the steps taken in manufacturing an embodiment of the present invention.

FIG. 10 shows steps taken in manufacturing at least one embodiment of the present invention. The process begins at 204. The substrate is obtained at 206, either in sheets or pre-made strips as discussed above. The substrate is cut to length at 208, if necessary, and then is prepared for the addition of the coating.

A determination is made at 210 whether color and/or printed text, or other images or logos, should be added to the substrate or color to the coating. If yes, the appropriate color, text, or other visual elements are added at 212. A determination is then made at 214 whether scent should be added to the coating. If yes, scent is added to the coating at 216. A determination is then made at 218 whether an auto-start lighter feature should be added to the fire starter system. If yes, that feature is installed near an end of the substrate strip at 220. A determination then is made whether to leave the end of the substrate uncoated at 222. If yes, preparation is made to leave the end of the strip uncoated at 224.

Once all the appropriate decisions as to how the final strips should be, and all features are applied, the substrate 6 is coated at 226 with the wax. The coated substrate is then cut to width at 228. A determination is made at 230 whether to add the wood shavings from FIG. 5 to the embodiment. If yes, wood shavings are added at 232, otherwise this step is skipped and the product folded for storage or sale and packaged at 234 and the process ends at 236.

VI. Method of Using Fire Starter System 252

Figure 11:
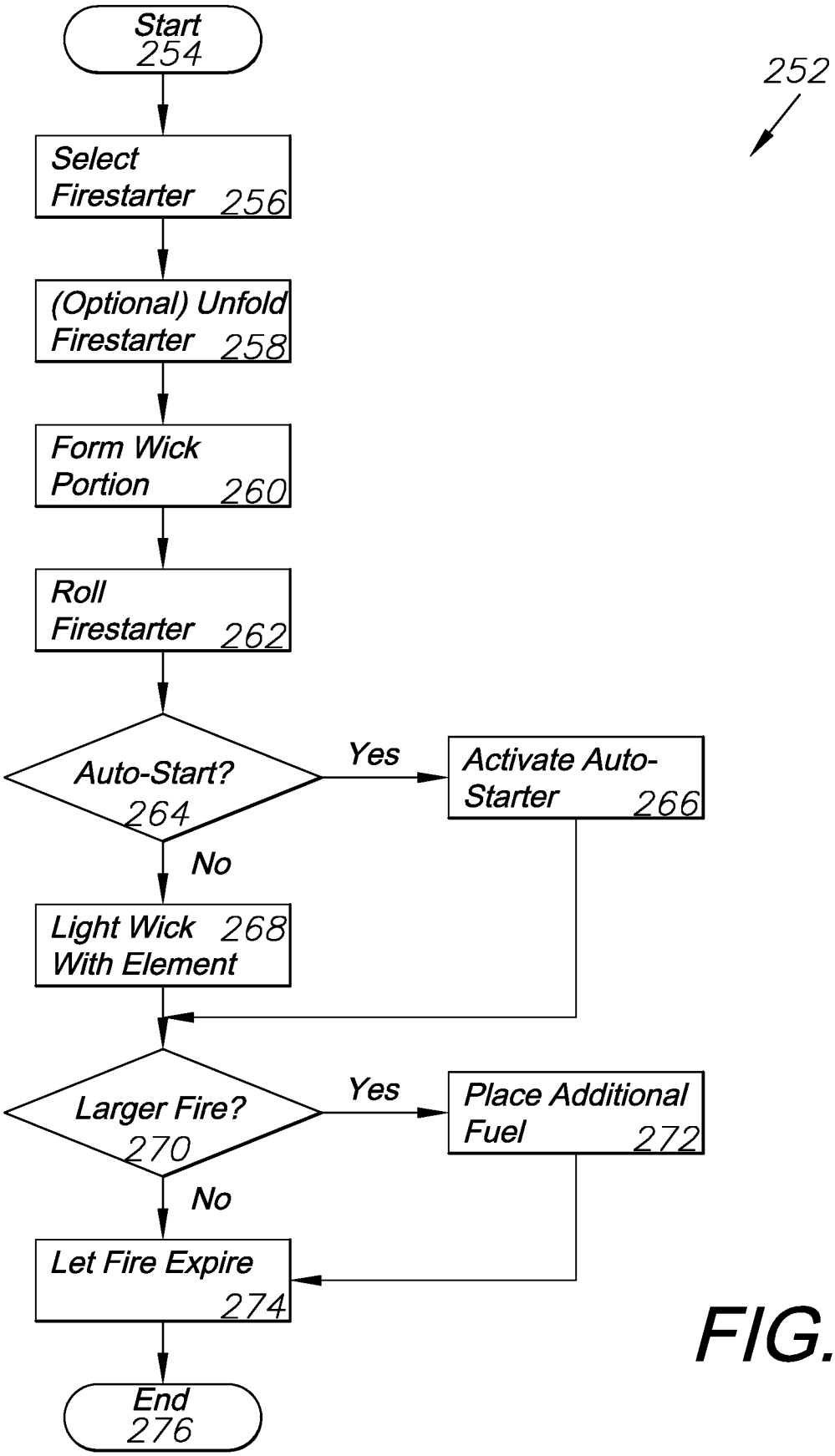
FIG. 11 is a flowchart diagramming the steps taken in practicing an embodiment of the present invention.

A method 252 of using the fire starter system is shown in steps illustrated by FIG. 11. The process starts at 254 and the fire starter to be used is selected by the user at 256. The fire starter is unfolded at 258, if the fire starter is obtained in a folded orientation. In some situations, the user will obtain the fire starter in an unfolded orientation, so step 258 may not be required.

Once rolled, the raised wick portion is pulled up at 260 to provide a lighting point, and rolled into a deployed orientation at 262. This step can be skipped if the user simply wants to light the strip unrolled. If there is an auto-start element installed at 264, the user can choose to activate the auto-start element at 266 to light the fire starter system. Otherwise the wick portion is lit at 268 using an external fire source, such as a match.

If a larger fire is desired at 270, additional fuel can be added at 272 to create a larger fire. This can be repeated as necessary, but once the user is done with the fire they will let the fire expire at 274 and dispose of the debris. The process then ends at 276.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A fire starter system comprising:

a fire starter strip comprising a substrate material coated in wax;

said fire starter strip configured to be folded into a first, packaged orientation forming a fire starter base;

said fire starter strip further configured to be unfolded into an unrolled, flat orientation;

said fire starter strip further configured to be rolled into a deployed orientation wherein an end portion of said fire starter strip is displaced to function as a wick;

said fire starter base and said wick are all comprised of said fire starter strip in a uniform body;

wherein said end portion of said fire starter strip is configured to be ignited; and wherein said end portion is ignited, thereby causing flames to engulf said fire starter strip over time.

2. The system of claim 1, wherein said wax is selected from a list comprising microcrystalline wax, CW-175 Micro A wax, CW-155 PET A micro crystalline wax, and paraffin wax.

3. The system of claim 1, wherein said substrate material is selected from a list comprising cloth and paper.

4. The system of claim 1, further comprising said end portion of said fire starter strip being uncoated with said wax, thereby enhancing flammability of said end portion.

5. The system of claim 1, further comprising a plurality of wood shavings applied to said fire starter strip at least about said end portion.

6. The system of claim 1, further comprising text printed onto said substrate.

7. The system of claim 1, further comprising an image printed onto said substrate.

8. The system of claim 1, wherein said wax comprises a scent.

9. The system of claim 1, wherein said wax comprises a dye.

10. The system of claim 1, further comprising:

an auto-light element comprising an igniter having an active element and a passive element;

said active element configured to be removed from said passive element, thereby creating a spark; and said spark configured to ignite said fire starter strip.

11. The system of claim 10, wherein said active element comprises an element selected from the list comprising: a pull string, a stick, a zipper, and a tear-away portion.

12. A method of manufacturing a fire starter, the method comprising the steps:

obtaining a substrate;

cutting said substrate to length;

printing onto said substrate;

preparing a coating comprising a scent and a micro crystalline wax;

coating said substrate with said coating, thereby forming a coated substrate;

cutting said coated substrate to a determined width into a strip;

orientating said coated substrate for storage by rolling said strip into a rolled body; and manipulating an end of said strip to be displaced away from said rolled body, said end of said strip to function as a wick.

13. The method of claim 12, further comprising the steps:

installing a passive auto-light element to said coated substrate; and installing an active auto-light element to said coated substrate in proximity with said passive auto-light element.

14. The method of claim 12, further comprising the step:

affixing wood shavings to at least one side of said coated substrate.

15. A method of creating a fire using a fire starter system, the method comprising the steps:

obtaining a fire starter comprising a substrate strip coated with a micro crystalline wax coating;

forming a wick portion with said fire starter, said wick portion comprising an end of said fire starter placed in an upward orientation;

rolling said fire starter into a rolled body, wherein said wick portion protrudes upwards from said rolled body, while said wick portion and said rolled body remain one uniform strip; and lighting said wick portion of said fire starter with a fire source, such that said substrate strip is ignited and burns, generating fire, and such that said micro crystalline wax coating melts in conjunction with the burning of said substrate strip.

16. The method of claim 15, further comprising the steps:

wherein said fire source comprises an auto-light element affixed to said fire starter about said wick portion, said auto-light element comprising a passive element and an active element; and activating said active element of said auto-light element, thereby causing a spark.

17. The method of claim 15, wherein text is printed onto said substrate.

18. The method of claim 15, wherein an image printed onto said substrate.

19. The method of claim 15, wherein said wax comprises a scent.

20. The method of claim 15, wherein said wax comprises a dye.

21. The method of claim 15, wherein said substrate comprises a scent.

22. The method of claim 15, wherein said substrate comprises a color changing component configured to change a color of said fire.

23. The method of claim 15, wherein said wax comprises a color changing component configured to change a color of said fire.

24. The method of claim 15, wherein said wax comprises an insect repellent chemical.

25. The method of claim 15, wherein said wax comprises a chemical having properties selected from a list comprising: antiseptic; and antibiotic.

* * * * *